United States Patent [19]

Rowland et al.

[11] 4,362,002

[45] Dec. 7, 1982

[54] METHOD AND APPARATUS FOR CLOSING A THIN-WALLED CONTAINER BODY

[75] Inventors: William G. Rowland, Faringdon; Arthur E. W. Morgan, South Oxhey; Kenneth R. Clark, Standlake, Near Witney, all of England

[73] Assignee: Metal Box Limited, Reading, England

[21] Appl. No.: 165,141

[22] Filed: Jul. 1, 1980

[30] Foreign Application Priority Data

Jul. 5, 1979 [GB] United Kingdom ..... 7923397

[51] Int. Cl.[3] ..... B67B 5/02; B65B 7/28

[52] U.S. Cl. ..... 53/478; 53/487; 53/488; 53/297; 53/373; 53/357

[58] Field of Search ..... 53/478, 487, 488, 297, 53/298, 373, 329, 362, 357; 156/69; 493/103, 104, 108, 109

[56] References Cited

U.S. PATENT DOCUMENTS

| | | | |
|---|---|---|---|
| 1,162,025 | 11/1915 | Buhles | 53/362 |
| 1,652,595 | 12/1927 | Weeks et al. | 53/297 X |
| 1,708,828 | 4/1929 | Bremmerman | 156/69 X |
| 2,008,802 | 7/1935 | Stanek et al. | 53/357 |
| 2,013,304 | 9/1935 | Glunz | 53/488 X |
| 2,086,552 | 7/1937 | Hogg | 53/362 X |
| 2,413,449 | 12/1946 | Hatch | 156/69 X |
| 2,677,318 | 5/1954 | Torudd et al. | 493/104 X |
| 2,684,192 | 7/1954 | Burdin | 53/297 |
| 2,799,981 | 7/1957 | Baker-Carr et al. | 53/478 |
| 3,475,243 | 10/1969 | Scalora | 156/69 |
| 3,549,440 | 12/1970 | Adcock et al. | 53/478 X |
| 3,792,566 | 2/1974 | Kinney | 53/298 |
| 4,196,841 | 4/1980 | Smith et al. | 156/69 X |
| 4,216,050 | 8/1980 | Schmit | 53/357 X |
| 4,297,161 | 10/1981 | Graffin | 53/478 X |

*Primary Examiner*—Horace M. Culver
*Attorney, Agent, or Firm*—Diller, Ramik & Wight

[57] ABSTRACT

A thin-walled can body having a terminal curled rim at an open end thereof, has this open end closed and sealed by a diaphragm which is first formed into a dished shape by a forming tool which then cuts the dished diaphragm from a web and places it on the open end of the body. The upturned edge portion of the diaphragm is subsequently pressed into adhesion between a heat-sealable layer of the diaphragm and the curled rim, the latter being hot, by a presser tool comprising a mount carrying a spring-loaded pad. The pad is resiliently deformable and applies controlled pressure directly on the diaphragm, thus effecting complete conformity of the latter to any irregularities of the curled rim.

5 Claims, 5 Drawing Figures

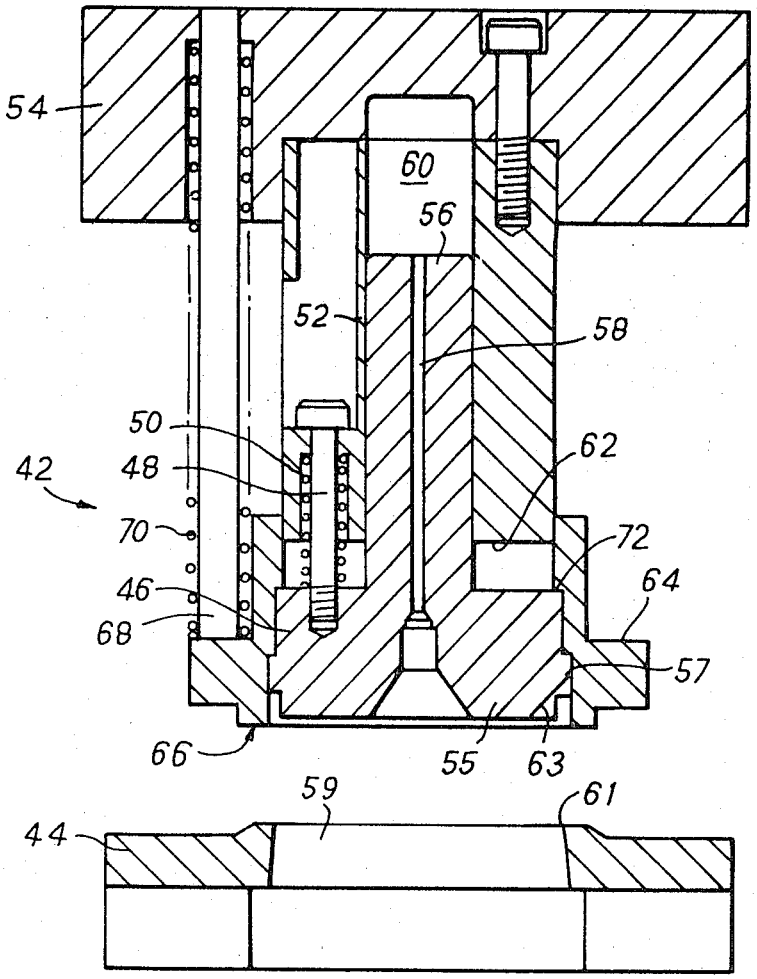
FIG. 2
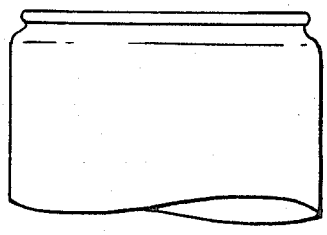

METHOD AND APPARATUS FOR CLOSING A THIN-WALLED CONTAINER BODY

This invention relates to methods and apparatus for closing an open end of a thin-walled, hollow container body, by application of a diaphragm which is adhered to the can body across the open end.

This specification will concern itself particularly with metal cans, but it is to be understood that the thin-walled container may be of any material (such as plastics or paperboard) suitable for use as a container for use by a consumer and for containing products which may typically be perishable, such as foodstuffs. The term "thin-walled" indicates that the walls of the container body are sufficiently thin to be likely to have randomly uneven contours. The wall will also, typically, have significant flexibility.

For some years there has been a requirement for a metal can which is hermetically sealed but which has a readily openable top to enable a consumer to gain access to the contents of the can without generating potentially harmful ragged metal edges. One proposal has been to seal one end (the top) with a diaphragm which is adhered to a rim formed on the can body. Such a can would be produced by the can manufacturer with an open bottom and the product manufacturer would invert the can, fill it and then close the bottom by conventional means, for example using a rigid metal base and a rolled double seam.

Since vacuum packing techniques are widely used by product manufacturers and since, too, certain products require storing in a completely sealed environment if they are to be preserved, the importance of achieving an adequate seal between the diaphragm and the can body is evident.

However here difficulties have arisen, in that there is a tendency for irregularities to occur in the contour of the rim to which the diaphragm is to be attached, particularly (though not exclusively) in the case of a can having a side seam. This has presented the problem of achieving an even distribution of pressure on the diaphragm whilst it is being secured to the rim to ensure that there are no gaps or weak regions in the seal formed between the two.

One attempt to avoid this problem is described in United Kingdom patent specification No. 1 361 415 and U.S. Pat. No. 3,358,876, which disclose a can in which the edge of the diaphragm is gripped between portions of the can body which are then squeezed together to clinch the periphery of the diaphragm. A somewhat similar arrangement was disclosed in United Kingdom specification No. 491 671. In practice, however, although arrangements of this kind have been used satisfactorily in cans for certain products, it has been found that a hermetic seal cannot always be obtained; furthermore such a can requires very expensive tooling and the cost of the container is therefore rather high. This reduces or cancels the well-known advantage of using a diaphragm, viz. that a diaphragm is itself a low-cost component. Thus, whilst use of diaphragms is common on glass jars (which are thick-walled, rigid containers), their adoption for thin-walled containers has never been widespread because of the technical problem of providing a reliable, low-cost way to seal the diaphragm hermetically to the container body.

Another solution is proposed in U.S. Pat. No. 3,892,351, which discloses an overcap of plastics material having a series of small ribs on its underside. A thick-walled composite container body has a diaphragm placed over its open end with adhesive between, and the overcap is placed over the diaphragm and pressed down whilst heat is applied. The heat deforms the ribs which then act in a manner of a wad, pressing the diaphragm against the end of the container body. Such an arrangement requires the provision of the special overcap, which is necessarily quite a complicated moulding and which, again, adds to the cost of the container. In addition, hermetic sealing depends on the integrity of the wad resulting from deformation of the ribs, and since the manner of this deformation is difficult to control, such integrity cannot be guaranteed.

There remains, after the above-mentioned prior art, a need for a simple way of applying a diaphragm to achieve reliably a hermetic seal at the end of a thin-walled container body, even when minor irregularities exist at the sealing surface. It is an object of this invention to supply a simple method and apparatus for satisfying that need.

In a first aspect, the invention provides a method of closing an open end of a thin-walled, hollow container body having a terminal curled rim about the said open end. In this method, a diaphragm having an adhesive coating on its underside is located on the open end with an edge portion of the diaphragm (extending around the entire periphery of the latter) in contact with the rim. In order to achieve a satisfactory area of contact, the diaphragm is wrapped at least part of the way around the curled rim. To this end, the diaphragm is pre-formed so that its said edge portion is upturned; thus the diaphragm when placed on the container has a dished shape. A presser tool is subsequently pressed down upon the diaphragm to adhere the latter to the rim of the body. The presser tool has a resiliently-deformable pad, and it is this pad that engages the diaphragm. Since the pad presses directly on the diaphragm under applied pressure, it deforms and presses down in exact conformity with the underlying contours of the container body rim, thus exerting a predetermined axial pressure at all points. In this way, no matter what minor undulations there may be in the sealing surface of the rim, the diaphragm is adhered to this surface over its whole area, thus enabling a hermetic seal to be easily and simply achieved.

In a second aspect, the invention provides apparatus for employing the above method to close an open end of each of a succession of the said bodies, the apparatus comprising: diaphragm feed means arranged for locating a diaphragm, having a pre-formed, upturned edge portion, on the open end of each body in succession with its edge portion in contact with the rim; sealing means including an axially-movable presser tool comprising a mount and a resiliently-deformable pad defining a leading end of the presser tool for pressing down upon, and in direct contact with, each successive diaphragm so located, the pad being resiliently carried by the mount for limited axial movement thereon whereby the pad can exert predetermined axial pressure on the diaphragm; and transfer means for effecting relative operative location as between each successive body and first the diaphragm feed means and then the sealing means.

It is preferred that the diaphragm should be formed, and placed on the container body, in a single operation. Accordingly, in preferred embodiments of the method of the invention, the diaphragm is cut from a planar web of material, is formed with its upturned edge portion, and is placed upon the open end of the container body, all in a single axial movement of a forming tool, after which a transfer takes place to align the body with the presser tool before the latter is pressed down upon the diaphragm.

Preferably, in order to ensure that the diaphragm is free of wrinkles when placed on the body, the planar web is gripped in a region surrounding the portion to be cut out to form the diaphragm, whilst the forming tool first stretched this portion to form it into a dished shape having an unwrinkled, upturned edge portion, and afterwards, by co-operation with a cutting edge, cuts the dished portion from the web.

The adhesive may be of any suitable kind providing a hermetic seal. Most conveniently it is of a heat-sealable kind, and in such a case the method includes heating the curled rim, the presser tool being operated whilst the rim is hot. This heat may be applied by pre-heating the rim, or in well-known manner by induction heating means associated with the presser tool. The use of induction heating per se in applying a diaphragm to a container is disclosed in U.S. Pat. Nos. 3,460,310 and 3,892,351. Induction heating is of course only possible where there is present electrically conductive material, as for example where the diaphragm includes a layer of metal foil and the container body is of metal.

A metal can or other thin-walled, hollow container, having a body with an open end closed and hermetically sealed by a diaphragm using a method according to the invention, and preferably using apparatus according to the invention, is included in the scope of the invention.

A method and apparatus therefor, according to the present invention, will now be described by way of example only, with reference to the drawings hereof, in which:

FIG. 2 is an elevation, partly in section, of a diaphragm cutting and forming device provided at a diaphragm feed station illustrated in FIG. 1;

Figure 1:
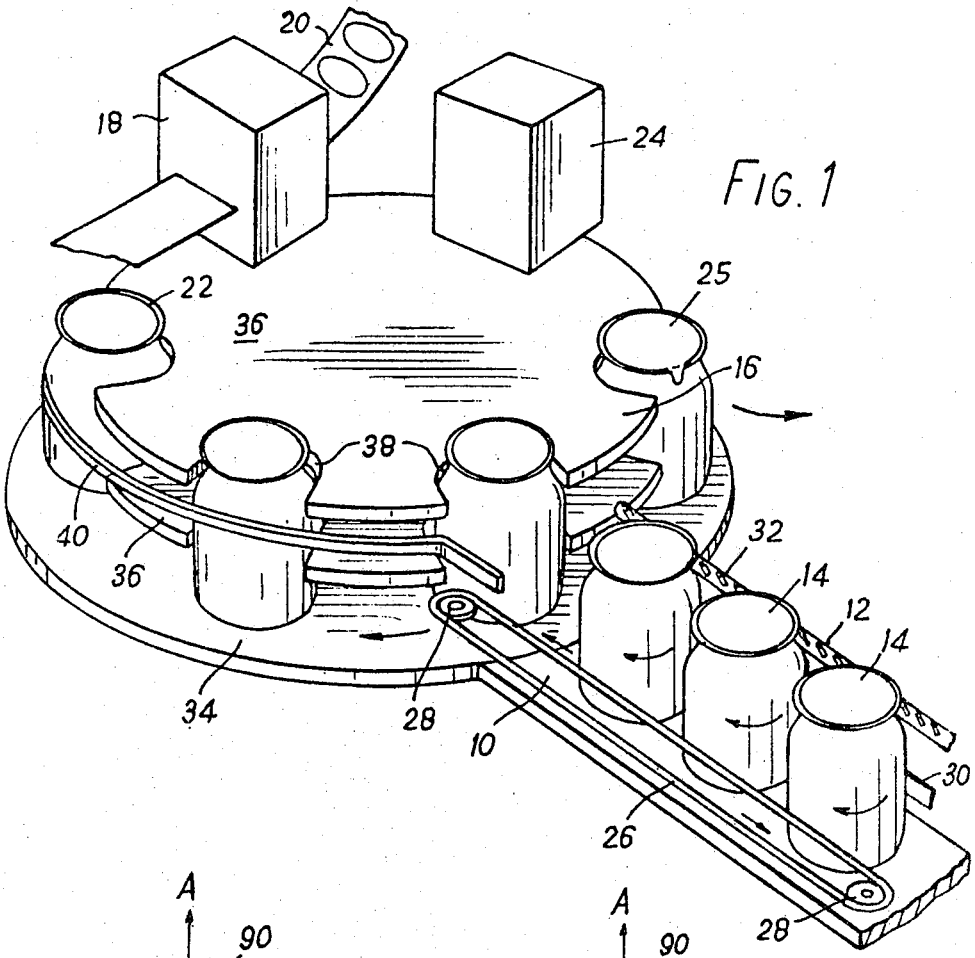
FIG. 1 is a simplified perspective view of an apparatus according to the invention.

Referring to FIG. 1, the illustrated apparatus basically comprises a fixed support 10 adjacent to which is mounted a heater 12, and analog which a succession of can bodies 14, open at both ends, are conveyed to an indexing transfer turret 16. The turret 16 is arranged to carry the bodies 14 to a diaphragm feed station 18, where diaphragms are cut from a web 20 and are brought into initial contact with a curled rim 22 at the open upper end of each can body 14. A sealing station 24 is situated downstream of the diaphragm feed station 18, for finally sealing the diaphragms to the can bodies, whilst a discharge station 25 is provided beyond the sealing station 24.

In order to convey the can bodies 14 along the support 10, a drive belt 26 is provided above and to one side of the support and is mounted about a pair of wheels 28 having vertical axes. One wheel 28 is driven by means not shown and the other is freely rotatable. The belt 26 co-operates with a fixed guide 30, disposed above and at an opposite side of the support 10, to advance the bodies 14 whilst rotating them. The heater 12 comprises an array of gas jets 32 mounted over the guide 30 and directed so that as the bodies are advanced along the support 10 their rims 22 are heated.

A fixed support 34 is disposed at the level of the support 10 to receive the bodies 14 once their rims have been heated. The turret 16 is disposed above the support 34 and has a pair of circular plates 36, provided at intervals about their circumferences with pockets 38 within which the bodies 14 are engageable, to carry the bodies in spaced relation to each successive station 18, 24, 25. A guide bar 40 retains the bodies 14 in the pockets 38.

At the diaphragm feed station 18, a diaphragm cutting and forming tool 42 (see FIG. 2) is synchronised with the turret 16 by conventional means, not shown, so as to operate when a can body 14 is present below a fixed cutting die 44, located coaxially below the tool 42, to cut a diaphragm from the web 20 (FIG. 1) and apply it lightly to the rim of the body 14. The die 44 has a die aperture 59 with a peripheral cutting edge 61. The tool 42 includes a punch 46, resiliently carried by way of slidable studs 48 and compression springs 50 on a projection 52 extending from a head 54 of the tool. A stem 56 of the punch is slidable within the projection 52 and contains an axial passage 58 which communicates, via a chamber 60 in the projection 52 and the head 54, with a source of vacuum (not shown). The punch itself has a stepped lower end 55 having a leading portion 63 of reduced area, i.e. its diameter is such as to pass through the die aperture 59 without touching the die. Behind the leading end portion 63, the punch has a portion 57 which is so dimensioned as to slide snugly through the die opening 59 and to co-operate with the cutting edge 61 on the die at the top of the opening 59, for cutting diaphragms from the web 20. The punch 46 is reciprocable through the die aperture 59 by a conventional mechanism, not shown.

Surrounding the punch 46 is a web holder 64 which has an annular lower gripping surface 66 aligned with an opposed, corresponding upper surface of the cutting die 44 for holding the web 20 therebetween during formation of each diaphragm. The holder 64 is mounted on the head 54, and guided for movement relative to the head, by slide rods 68, and is resiliently urged away from the head by compression springs 70 if subjected to an appropriate axial force. A shoulder 72 on the punch 46 serves to limit downward movement of the web holder 64. When the holder 64 engages the shoulder 72 the gripping surface 66 of the holder 64 is positioned slightly below the level of the lower end of the punch 46.

The web 20 (not shown in FIG. 2) is arranged to pass horizontally through the gap between the cutting die 44 and the punch 46. The web may be formed from various materials but in each case it has a heat-sealable coating on its lower surface. For example, this coating may comprise a copolymer of ethylene and acrylic acid in which part of the acrylic acid has been reacted to an ester (e.g. the material sold under the Trade Mark KUROPLAST) or with a metal ion (e.g. the material sold under the Trade Mark SURLYN). The substrate of the web carrying the coating may be, for example, paper, aluminium foil or a laminate of paper and aluminium foil.

Figure 3:
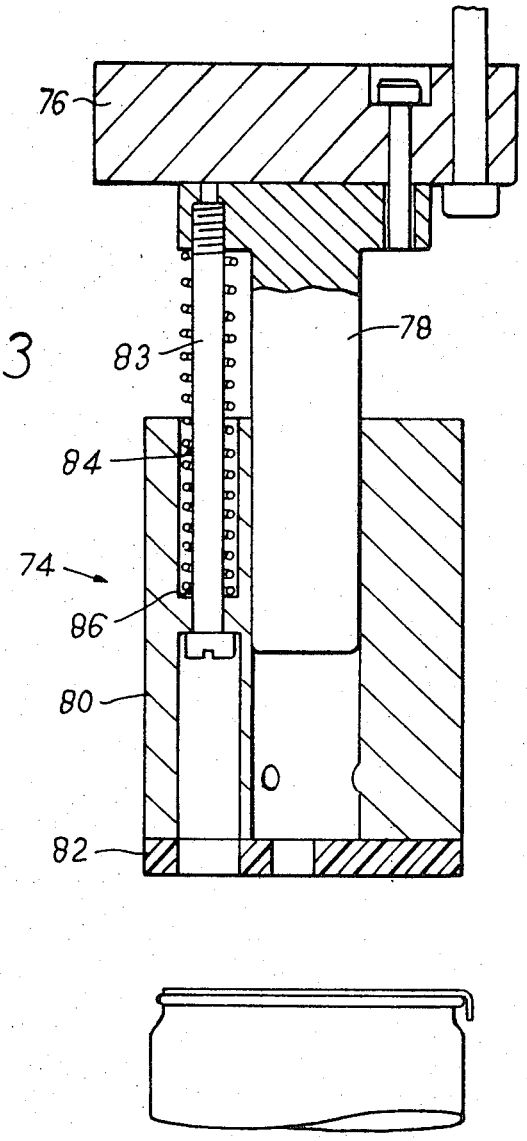
FIG. 3 is an elevation, partly in section, of a presser tool provided at a sealing station illustrated in FIG. 1.

FIG. 3 shows a presser tool 74 at the sealing station 24 (FIG. 1). The presser tool is movable axially, with respect to a can body located coaxially below it, by conventional means not shown, and includes a mount 76 having a projection 78 on which a slider 80 is axially slidable. The lower end of the presser tool is defined by a resiliently-deformable pad 82 secured to the slider 80. The pad 82 typically has a Shore hardness of at least approximately 60. The slider 80 is located on the projection 78 by studs 83 and is resiliently urged downwardly by compression springs 84 acting between a shoulder of the mount 76 and shoulders 86 presented by regions of the slider 80 encircling the studs 83. The presser tool 74 is synchronised with the turret 16 so as to operate when a can body is present below the slider 80.

Operation of the apparatus is as follows:

Can bodies are supplied to the support 10 and are advanced along this support by the action of the belt 26 which presses the bodies against the guide 30 to cause frictional engagement between the bodies and the guide, which in effect rolls the bodies along the guide. At the same time, the gas jets 32 heat the rims 22 of the bodies and by virtue of their rotation, the entire rim of each body is heated during its journey along the support 10.

The belt 26 continues to advance each can body until it engages within a pair of the pockets 38 of the turret 16. As the turret rotates, the can body passes almost immediately behind the bar 40 and is thus prevented from leaving the pockets.

Indexing of the turret 16 conveys the can body to the diaphragm feed station 18, where the body is halted immediately under the die 44 (FIG. 2). The head 54 is now lowered, the punch 46 and web holder 64 moving together, to cause the gripping surfaces 66 of the web holder 64 and die 44 to grip the web 20. Further lowering of the head 54 next causes the punch 46 to continue moving downwardly, compressing the springs 70. The reduced-diameter lower end portion 63 of the punch thus presses the web downwardly, so that stretching occurs to form in the web a dished region having a flat base surrounded by an upturned, sloping edge portion. At this stage no cutting of the web takes place because of the clearance between the reduced portion 63 of the punch and the cutting edge 61 of the die. The presser with which the annular surface 66 of the web holder 64 holds the web against the corresponding upper surface of the cutting die is selected, by appropriate choice of stiffness of the springs 70, to ensure that wrinkling of the upturned edge portion does not occur during this stretching step. Lowering of the head 54 is continued until the wider portion 57 of the punch reaches the cutting edge 61 of the die, whereupon the dished region of the web is severed from the remainder of the web to form a diaphragm having an upturned edge portion.

This diaphragm is held in contact with the lower end of the punch by the application of section through the passage 58, whilst the head 54 is lowered still further until the diaphragm is brought lightly into contact with the curled rim of the can body standing below the cutting die 44. During this action the web holder 64 remain engaged with the cutting die and thus the projection 52 moves downwardly within the holder 64. The upturned edge strip of the diaphragm assists is locating the latter relative to the rim 22, and engages an inner region 90 of the rim. The rim 22 is still hot, and so the diaphragm adheres to the rim and is indexed thereby to the sealing station 24.

At the station 24, the slider 80 is lowered towards the can body. As the resilient pad 82 on the slider makes direct contact with the diaphragm and passes it against the still-heated rim 22, the pad deforms resiliently and applies an axial force, predetermined by the springs 84, over the entire sealing area, whereby the pad 82, and consequently the diaphragm, conforms both radially and circumferentially to the contours of the underlying rim, thus ensuring that the heat-sealable coating of the diaphragm is heated and the diaphragm is thereby sealed about the entire periphery of the can. If there are any irregularities in the contour of the rim, nonetheless the pad deforms to accommodate these and the diaphragm is sealed here too. Furthermore, since the pad conforms radially as well as circumferentially to the contour of the rim, the resulting annular sealed region has greater strength than would be provided if the diaphragm were merely adhered to the rim along a single line of contact.

Figure 4:
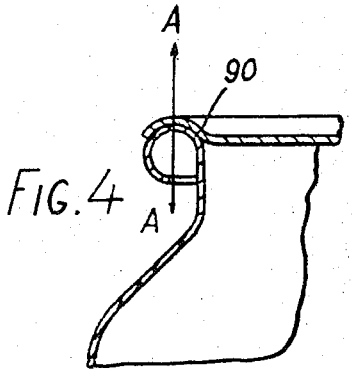
FIGS. 4 and 5 are fragmentary sectional views through two cans sealed by diaphragms using the apparatus of FIGS. 1 to 3.
Figure 5:
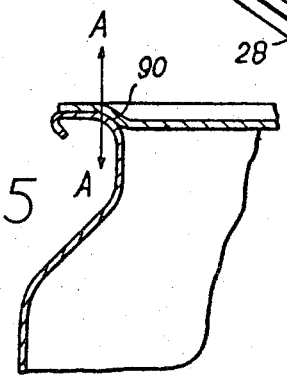

FIGS. 4 and 5 illustrate the degree of radial contact which is possible in the case of two can bodies having curled rims with differing radial contours. These Figures also show how the degree of radial contact is enhanced by providing the upturned edge portion 90 on each diaphragm. Hence this enables the diaphragm to be sealed to the inner as well as to an upper region of the rim. If the diaphragm were initially applied flat to the rim, sealing would instead be achieved only radially outwardly of the lines A—A in FIGS. 4 and 5.

Finally the pad 82 is withdrawn, returning to its original undeformed condition in preparation for application to the succeeding curled rim, and the can body is advanced by the turret 16 to the discharge station 25, where it is removed by conventional means, not shown.

It will be appreciated that the transfer means may consist of an in-line indexing conveyor instead of a turret. The tools 42, 44 and 74 may be mounted on a turret so as to move in relation to the can bodies, the latter being presented to the tools one by one by a suitable handling device so that each can is stationary from the time it is presented to the diaphragm feed tool 42 until the diaphragm has been sealed to it by the sealing tool 74. It will also be understood that the action of the tools need not necessarily be downward, since the operation does not rely on gravity. Thus the cans may be presented vertically or in any other convenient orientation, the orientation of the tools being chosen accordingly.

We claim:

1. In a method of applying, over an open end of a thin-walled, hollow container body, having a terminal curled rim about said open end, a diaphragm having an adhesive coating on its underside, the steps of: (a) gripping a planar web of material in a region surrounding a web portion to be cut therefrom to form said diaphragm, (b) whilst said web is so gripped, applying a forming tool to stretch said web portion to form it into a dished configuration comprising a central panel portion, a peripheral flange surrounding said central panel portion, and an upturned portion surrounding said central panel portion and joining the latter to the peripheral flange, whereby aid upturned portion is unwrinkled, (c) after said step of stretching the web portion, further applying said forming tool so as to cut said web portion from said web and place it upon the open end of the container body so as to constitute said diaphragm, with said upturned portion with the open end of the container body and said peripheral flange and upturned portion in contact with said rim, steps (a) to (c) being performed in a single movement of said forming tool (d) transferring said container body with said diaphragm thereon to a position in alignment with a presser tool having a resiliently-deformable pad, and (e) applying said presser tool axially against the diaphragm with said pad in direct contact therewith, and exerting predetermined, substantially even pressure upon said flange and upturned portion whereby to cause them to adhere to, and conform with the underlying contours of said rim.

2. A method according to claim 1 wherein the adhesive coating is a heat-sealable coating, the method including heating the curled rim, and the presser tool being operated whilst the rim is hot so as to melt the coating where it overlies the rim.

3. Apparatus for applying a succession of diaphragms to a succession of thin-walled, hollow container bodies, each said body having a terminal curled rim defining an open end of said body, and each said diaphragm having a disked configuration comprising a central panel portion, a peripheral flange surrounding said central panel portion, and an upturned portion surrounding said central panel portion and joining the latter to the peripheral flange, said diaphragm having an adhesive coating on its underside whereby the upturned portion and peripheral flange are adhered to said rim of the corresponding container body, said apparatus comprising: (a) diaphragm forming means for making said diaphragms and for placing them upon the open end of each body in succession with its said edge portion in contact with said rim, (b) sealing means comprising a presser tool and means for moving said presser tool axially with respect to a said body located coaxially therewith, and (c) transfer means comprising container body holding means and means for effecting relative movement as between said holding means and said diaphragm forming means and sealing means, said presser tool comprising a mount, a resiliently-deformable pad defining a leading end of the presser tool, and resilient means mounting said pad on said mount for limited axial movement thereon, whereby said pad can press down with predetermined axial pressure upon, and in direct contact with, each successive diaphragm located on said body by the feed means, the said diaphragm feed means comprising a fixed, apertured die, a forming tool including a punch, means for reciprocating said punch through the die, a web holder for locating planar diaphragm material between the punch and die, and web holder mounting means mounting said web holder around the punch, the punch having a leading end of reduced area such as to pass through the die without touching it, whereby the punch and die can co-operate to form said material into said dished configuration as the punch moves towards the open end of the body to locate thereon the diaphragm so formed, said web holder mounting means being arranged for axial movement with respect to said punch if subjected to an appropriate axial force but normally for axial movement with the punch, the web holder and die each having one of a pair of opposed gripping surfaces surrounding the punch and the die aperture whereby upon initial axial movement of the punch and web holder together, the gripping surfaces are brought together to grip a planar web of diaphragm material between them, the punch then continuing its own axial travel through the die to form said dished shape by stretching the material so gripped, the die aperture having a peripheral cutting edge and the punch having behind its leading end a portion for co-operating with said cutting edge to sever the dished diaphragm from the web.

4. Apparatus according to claim 3, wherein said presser tool further comprises a slider, compression spring means mounting the slider on said mount, and means securing the resiliently-deformable pad on the slider.

5. Apparatus according to claim 4 or 3 including heating means for heating the curled rim of each successive container body so that said rim is hot, at least when the body is located at the sealing means.

* * * * *